US005785265A

United States Patent [19]

Rom et al.

[11] Patent Number: 5,785,265

[45] Date of Patent: Jul. 28, 1998

[54] WINDING MACHINE FOR A CONTINUOUSLY ARRIVING YARN

[75] Inventors: Jürgen Rom, Meinhard; Jörg Bamberg, Eschwege, both of Germany

[73] Assignee: Georg Sahm GmbH & Co. KG, Eschwege, Germany

[21] Appl. No.: 732,551

[22] Filed: Oct. 15, 1996

[30] Foreign Application Priority Data

Oct. 16, 1995 [DE] Germany ..... 195 38 480.6

[51] Int. Cl.[6] ..... B65H 63/00

[52] U.S. Cl. ..... 242/36; 242/18 A; 242/18 DD

[58] Field of Search ..... 242/18 R, 18 A, 242/18 DD, 36

[56] References Cited

U.S. PATENT DOCUMENTS

| | | | |
|---|---|---|---|
| 4,059,239 | 11/1977 | Hori et al. | 242/18 R |
| 4,106,710 | 8/1978 | Schippers et al. | 242/18 R |
| 4,964,582 | 10/1990 | Hermanns et al. | 242/18 R |
| 5,029,762 | 7/1991 | Behrens et al. | 242/18 |
| 5,100,072 | 3/1992 | Behems et al. | 242/18 DD |
| 5,141,169 | 8/1992 | Sugioka | 242/18 R |
| 5,407,143 | 4/1995 | Nakai et al. | 242/18 |
| 5,462,239 | 10/1995 | Klee et al. | 242/18 R |
| 5,558,286 | 9/1996 | Sugioka et al. | 242/18 A |

FOREIGN PATENT DOCUMENTS

| | | |
|---|---|---|
| 0 374 536 B1 | 11/1989 | European Pat. Off. . |
| 0 374 536 A2 | 6/1990 | European Pat. Off. . |
| 38 10 365 A1 | 10/1989 | Germany . |
| 39 11 854 A1 | 11/1989 | Germany . |
| 44 23 491 A1 | 1/1996 | Germany . |

OTHER PUBLICATIONS

Patent Abstracts of Japan, Publication No. 08290870, Publication Date May 11, 1996, Application Date Apr. 24, 1995 App. No. 07098650, Applicant Murata Mach Ltd., Inventor Kato Hisaaki, Bobbin Position Adjusting Method.

*Primary Examiner*—William Stryjewski

*Attorney, Agent, or Firm*—Thomas, Kayden, Horstemeyer & Risley

[57] ABSTRACT

A winding apparatus and method for continuously winding yam onto a bobbin. The apparatus having a winding drum with winding spindles mounted thereon. The drum continuously rotates during the wind up process in which the package gets built up on the bobbin received on the winding spindle. A contact roller positioned upstream of the winding drum and contacting the bobbin and a drive for independently rotating the winding drum and the winding spindle with a sensors for sensing the respective rotational speed of the contact roller and the winding spindle. The signal of the sensors use to regulate the drive of the winding drum and the winding spindle such that the winding drum is continuously rotated during the winding process and the winding spindle is continuously moved away from the contact roller as the amount of yarn wound on the bobbin increase so that the contact roller remains in peripheral contact with the bobbin throughout the winding process.

18 Claims, 4 Drawing Sheets

WINDING MACHINE FOR A CONTINUOUSLY ARRIVING YARN

FIELD OF THE INVENTION

The invention concerns a winding machine for a continuously driving yarn, comprising a rotatable drum on which two drivable winding spindles are rotatably mounted, a laying device and a contact roller which is arranged upstream of the drum in the path of movement of the yarn, wherein the contact roller is in peripheral contact with the bobbin which is formed on the winding spindle that is in operation, and the spacing between the axis of the contact roller and the axis of the winding spindle that is in operation is variable in the direction of an increase, in accordance with the increasing diameter of the bobbin. Also described is a method of regulating a winding machine for a continuously arriving yarn in which a drum on which two drivable winding spindles are rotatably mounted is rotated relative to a contact roller and the yarn is wound with a laying device by way of the contact roller on to the bobbin, wherein the spacing between the axis of the contact roller and the axis of the winding spindle that is in operation is varied in accordance with the increasing diameter of the bobbin.

BACKGROUND OF THE INVENTION

An example of one known winding machine is disclosed in EP 0 374 536 B1. The contact roller which is used in that machine is mounted pivotably on a rocker arm or displaceably with a rectilinear movement in a straight guide means. There is provided a sensor which detects the movement of the contact roller relative to the surface of the bobbin which is being formed on the winding spindle that is in operation. The sensor forms part of a control arrangement and operates as a two-point control member. If the contact roller is moved beyond the extent which is set at the sensor, by the increase in the bobbin diameter that takes place in the winding operation, when the shaft of the drum is stationary, then a control pulse is passed to the rotary drive of the drum and the drum is rotated so that the direction of movement of the contact roller is reversed so that the diameter will drop below the set triggering point at the control member. The drive for the drum is then stopped. The drum is therefore driven in small steps, each step being performed at a respective constant angular speed. Although the moved contact roller covers only a relatively short travel distance, for example 2 mm, that movement is nonetheless a necessary prerequisite for control of the rotary drive of the drum. The movement of the contact roller and the control of the drum, which is triggered thereby, not only result in different contact pressure forces as between the contact roller and the periphery of the bobbin, but those contact pressure forces also exhibit an irregular pattern. The accuracy with which the yarn is laid on the bobbin is adversely affected by the displacement of the line of contact between the contact roller and the periphery of the bobbin as it is being formed. Another disadvantage is that the switching frequency of that control arrangement with the sensor decreases in the course of the winding phase. In contrast the switching travel of the sensor remains constant. Due to the outward movement of the bobbin when the drum is rotating and due to the bobbin diameter growing at an increasingly slower rate, the number of control steps per unit of time decreases, that is to say the change in the contact pressure force, by way of the contact roller, slows down. A further disadvantage is that a separate expensive control arrangement is required for control purposes.

SUMMARY OF THE INVENTION

It is an object of the present invention to provide a winding machine, which is inexpensive to produce and easy to maintain and which is also of small structural size.

In accordance with the invention, the winding machine comprises a regulating device is provided for controlling the rotation of a winding drum, a device for detecting the speed of the yarn, and a device for detecting the speed of rotation of a winding spindle that is mounted to the drum and support a bobbin of yarn being formed thereon. The regulating device has a computing unit for computing the respective current diameter of the bobbin being formed on the winding spindle using the sensed current angular speed between the beginning and the end of each computing cycle as regulating parameters for the rotary movement of the drum over the entire winding phase.

The invention is based on the concept of firstly providing a regulating device instead of the known control arrangement, in order thereby to regulate the rotary movement of the drum in a quasi-constant movement sequence. This can be such that for example a computing cycle occurs every 10 ms, and the computing cycle is followed by a respective regulating cycle, thereby providing a quasi-steady movement of the drum during the winding phase. It is advantageous that the winding machine does not require any additional elements such as sensors or the like for the regulating action, but uses elements which are present in any case and which are provided for controlling the yarn tension on the winding machine. Thus, the machine utilises a device for detecting the speed of the yarn and a device for detecting the speed of rotation of the winding spindle that supports the bobbin being formed by the winding process. By way of the computing unit which can be a component of the regulating device, the yarn speed and the speed of rotation of the winding spindle are used to calculate the respective current diameter of the bobbin being formed and to ascertain the respective current angular speed between the beginning and the end of each computing cycle. The drum is further rotated at that current angular speed. Accordingly, a respective reference to target value with respect of the rotary angle for the drum is ascertained from each calculation of the respective current diameter. The current angular speed at which the drum is further rotated is computed from the measured period of time which has elapsed between the beginning and the end of each computing cycle, and the respective reference or target value of the rotary angle. The reference or target value of the drum rotary angle is the angle between the axis of the winding spindle at the beginning and at the end of a respective computing cycle, in relation to the axis of the drum. It is advantageous in that respect that there is no need for any additional sensors, but sensors which are already provided for yarn tension regulation are used. The regulating device is no longer dependent on a movement of the contact roller, that is to say the contact roller can be arranged and designed with total freedom. For example it is possible to apply to the periphery of the bobbin being formed, by way of the contact roller, a contact pressure force of steady state nature which is based on criteria that are independent of the regulating action. Here for example it is also possible to provide for a steady reduction in the contact pressure force, without fluctuations, and that has an advantageous effect on the bobbin structure.

A microprocessor can be provided as the computing unit. Such a microprocessor represents a suitable structural unit for embodying the computing unit. The microprocessor can combine the most widely varying desired computing operations and steps as are also required inter alia for yarn tension regulation.

The device for detecting the speed of the yarn may have a device for ascertaining the speed of rotation of the contact roller. As the diameter of the contact roller and the run-on angle at which the yarn is laid inclinedly on to the periphery of the contact roller are known, the speed of the yarn can be easily computed therefrom. It is however also possible to use any other device for detecting the speed of the yarn, for example a separate device which is arranged upstream of the laying device or also at another location.

It is particularly advantageous if the device for detecting the speed of the yarn and the device for detecting the speed of rotation of the winding spindle that is in operation are also in the form of a regulating device for regulating the rotary movement of the drum. That arrangement provides that elements which are present in any case are put to use for that purpose.

The contact roller can be mounted deflectably relative to the axis of the drum and thus relative to the respective winding spindle, in that there is provided a device for controlling a constant or a controlledly variable contact pressure force of the contact roller against the winding spindle upon which the bobbin is being formed. Deflectable mounting of the contact roller is desirable on the one hand so that the drum with the two winding spindles can be turned through a complete revolution. As however the contact roller does not necessarily have to move, it is still possible to provide for a movement of the contact roller, in which case however that movement then serves for a different purpose, namely applying a contact pressure force or a variation in contact pressure force in the course of the winding phase.

The computing unit may have a storage means for accommodating a value table in respect of the reference or target value of the angle of rotation of the drum in dependence on the diameter of the bobbin. It will be appreciated that such a value table can be inputted, depending on the respective situation of use involved. It is however also possible for the computing unit to be so designed that the reference or target value of the drum rotary angle is calculated in dependence on the diameter of the bobbin. In that case the computing cycle will then admittedly last somewhat longer, but that does not involve any disadvantageous consequences, having regard to the parts of the winding machine, which are to be mechanically moved.

The method of regulating a winding machine is characterised in accordance with the invention in that the drum is continuously rotated at angular speeds which alter from one computing cycle to another.

In terms of the method, the invention is based on the idea of departing from a procedure which involves the drum alternately rotating and stopping, as is known in the state of the art, and instead providing an uninterrupted continuous rotary procedure for the drum. In that situation, varying angular speeds are successively used, that is to say, from one angular speed, the rotary drive for the drum is switched over to another angular speed, so that in any event the drum is continually moving, the pattern of the varying angular speeds being of a hyperbolic character. In general the current angular speeds being used decrease in the course of a winding phase. Depending on the respective geometrical relationships in the arrangement of the elements of the winding machine design, the angular speeds may however also increase slightly again at the end of a winding phase. In that region however the variation in the angular speed from one regulating cycle to another is not especially great.

It is advantageously possible to use computing cycles which are repeated at time intervals that are constant over the winding phase, for example in particular intervals of 10 msec. Repetition of the computing cycles at such short intervals of time is certainly possible. There is however no detriment if the number of computing cycles is reduced and the time intervals are increased since the drive for the drum in any case includes a plurality of mechanical elements which are found to involve a comparative amount of inertia. It is also possible to use different numbers of computing cycles on the one hand and regulating cycles on the other hand, to form mean values, or the like. In general however that is not necessary.

It is possible to provide a method in which the current angular speed of the rotary movement of the drum is altered during each regulating cycle in dependence on a constant increase in the diameter of the bobbin. For each unit of time, the diameter of the bobbin will increase comparatively less quickly at the end of the winding phase than at the beginning of a winding phase. Conversely, the angular speeds will alter substantially more greatly at the beginning of a winding phase than at the end of a winding phase. The reference or target value of the drum rotary angle in the course of the winding phase remains constant over a greater region in particular in the middle region of the winding phase.

The respective current angular speed of the rotary movement of the drum is calculated from the respectively preceding regulating cycle. That admittedly represents a minor error. That error can however be readily tolerated because the required degree of accuracy is achieved by virtue of the plurality of computing cycles and regulating cycles.

BRIEF DESCRIPTION OF THE DRAWINGS

The invention is further described and illustrated with reference to the drawings in which.

DETAILED DESCRIPTION

Figure 1:
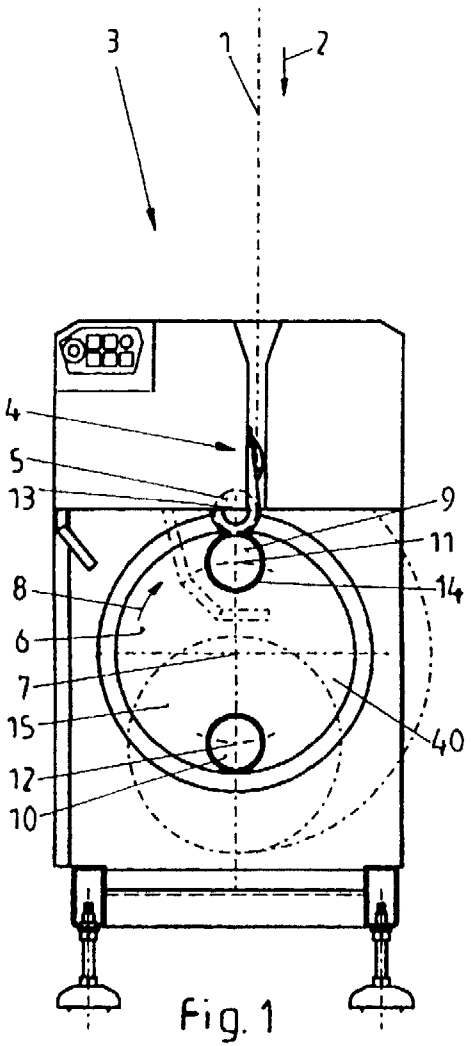
FIG. 1 shows a front view of the structure of a winding machine.

Referring to FIG. 1, shown therein is a yarn 1 which is continuously fed in the direction of an arrow 2 from a spinning shaft to a winding machine 3. The yarn passes by way of a laying device 4 on to the periphery of a contact roller 5. In the region below or laterally of the contact roller 5, a winding drum 6 is mounted rotatably or pivotably about its central rotation axis 7 as indicated by an arrow 8. The winding drum 6 has a drum face 40. First and second spindles 9 and 10 are rotatably mounted on the drum face 40. In the illustrated example, the axes 11 and 12 of the winding spindles 9 and 10 are oriented vertically beneath the axis 13 of the contact roller 5. An empty tube 14 is first winding spindle 9. The first winding spindle 9 is shown in the operative or winding position, that is to say at the beginning of a winding-on operation or a winding phase. The second winding spindle 10 with a wound bobbin 15 disposed thereon is in the reserve or bobbin change position in which the bobbin change operation or the doffing operation is effected.

Figure 2:
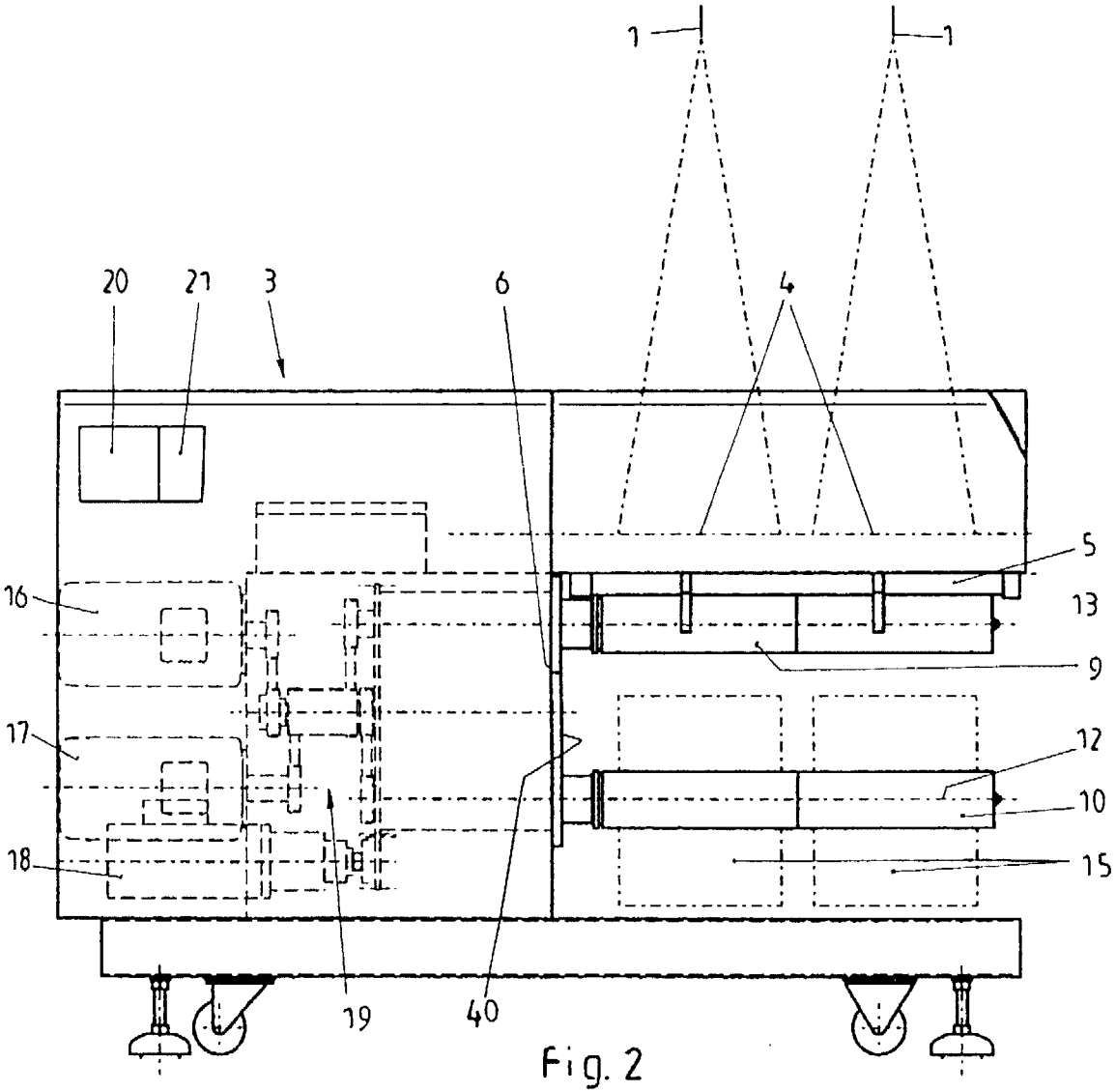
FIG. 2 shows a diagrammatic side view of the winding machine.

It can be seen from FIG. 2 that the winding machine 3 is of such a design configuration that two yarns 1 are simultaneously wound on to two bobbins 15. The winding machine 3 has a first spindle motor 16 for driving the winding spindle 9 in the operative position and in the reserve position. A second spindle motor 17 is provided for driving the second winding spindle 10 in the reserve position and the operative position. Finally a drum motor 18 serves to drive the drum 6. Accordingly, the apparatus comprises several drive means which independently rotate the winding drum and winding spindles. A transmission 19 serves to transmit the rotary drive of the two spindle motors 16 and 17 to the winding spindles 9 and 10 respectively, in spite of the pivotability thereof, by way of the drum 6. The winding machine 3 has a diagrammatically illustrated regulating device 20. A computing unit 21, for example in the form of a microprocessor, can be a component of the regulating device 20.

Figure 3:
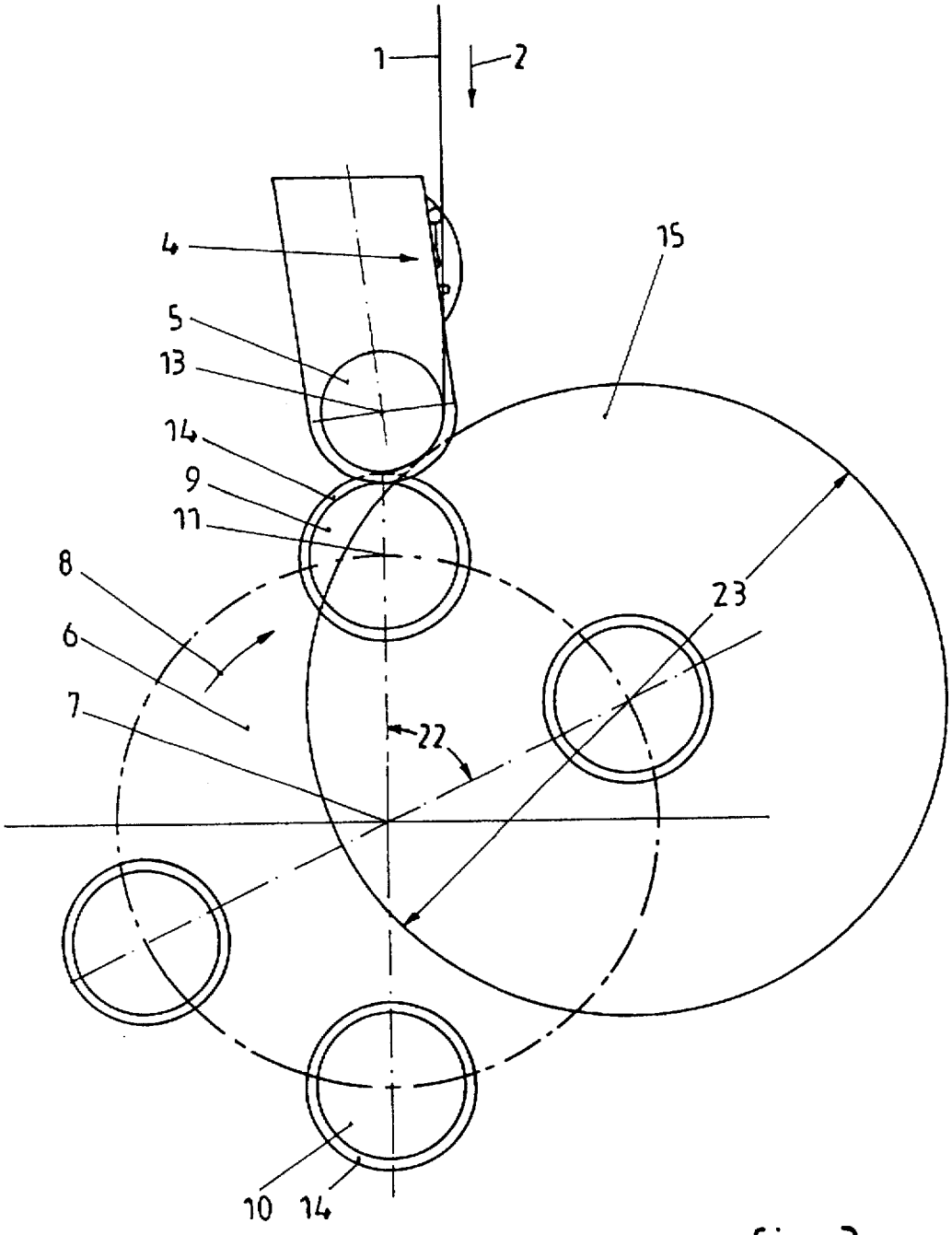
FIG. 3 is a view of the relative arrangement between the contact roller and the winding spindles on the drum.

FIG. 3 shows once again the relative positions during a winding phase. The first winding spindle 9 is shown with its axis 11 and the empty tube 14, beneath the contact roller 5, at the beginning of the winding operation. The periphery of the contact roller 5 bears against the periphery of the tube 14. During the winding phase or during the winding-on procedure, the drum 6 is continuously slowly rotated as indicated by the arrow 8 first winding spindle 9 on which the bobbin 15 is formed is displaced in the clockwise direction. As indicated in the figure the pivotal or rotary movement of the drum 6 takes place over a rotary angle 22. It will be appreciated that, during such rotary movement second, the winding spindle 10 rotates with the drum 6 in the same direction of rotation. The rotary angle 22 increases as the diameter of the bobbin 15 increases as the first winding spindle 9. The rotary angle 22 is the angle which is defined between the axis 11 of the winding spindle 9 or 10 that is in the winding position, at the beginning of the winding-on procedure, and near the end of a winding phase, in relation to the stationary axis 7 of the drum 6. It can be seen therefrom that a given rotary angle 22 is associated with a given diameter 23 of the bobbin 15. It can also be seen from FIG. 3 that the periphery of the contact roller 5 always bears against the periphery of the bobbin 15 which is being formed, but that the point of contact varies. That variation depends on the geometrical relationships of the arrangement of the parts relative to each other. In the course of a winding phase, the point of contact can initially move in such a way that the looping angle with which the yarn 1 extends around the periphery of the contact roller 5 initially decreases but then increases again towards the end of a winding phase. The contact roller 5 can be mounted in such a way as to be deflectable relative to the axis 7 of the drum 6 by way of a mounting arrangement (not shown here). It is also possible to provide a device for controlling a constant or a controlledly variable contact pressure force of the contact roller against the periphery of the bobbin 15 which is being formed on the winding spindle that is in operation.

Figure 4:
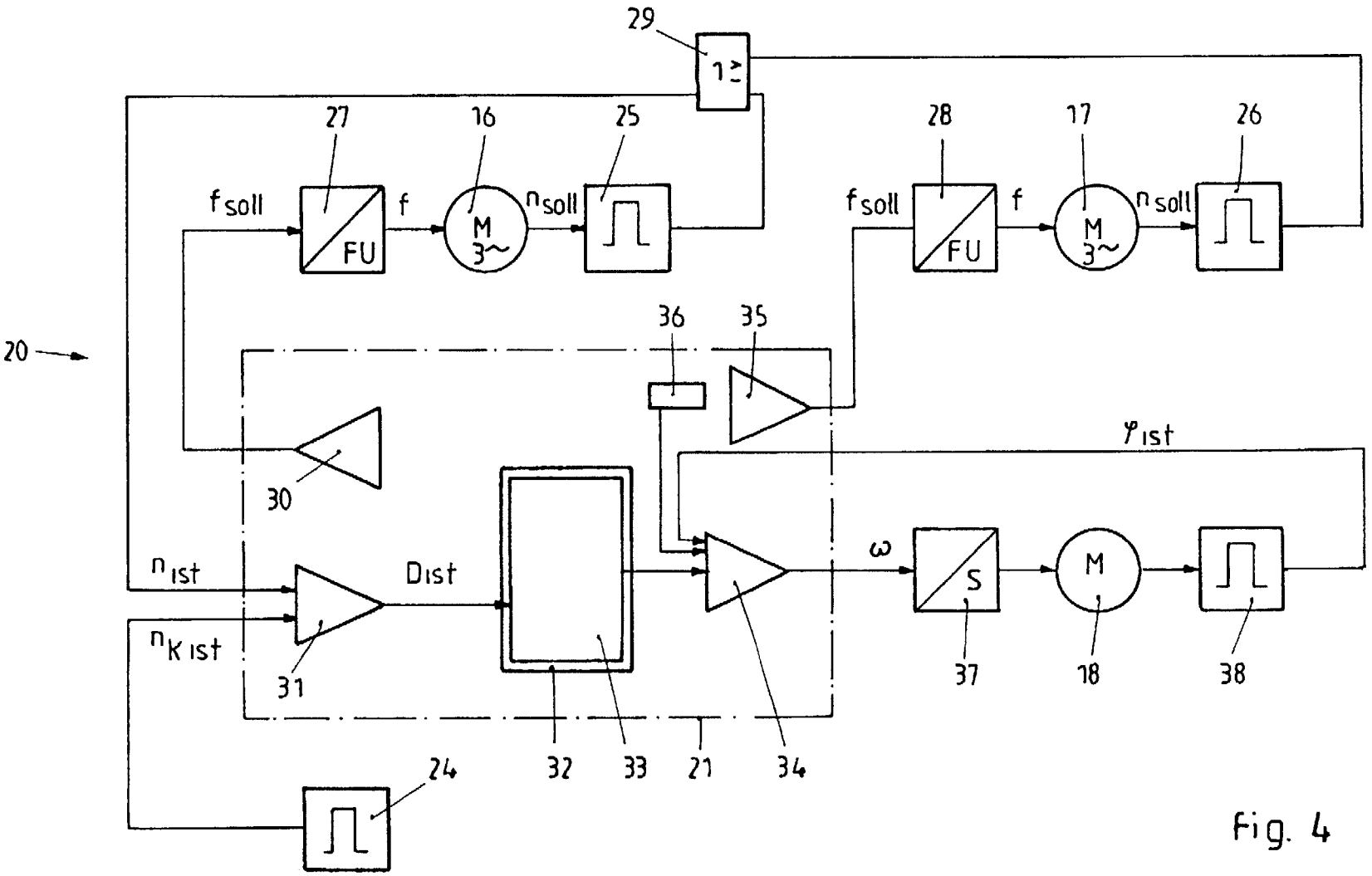
FIG. 4 shows a preferred embodiment of the regulating device in the form of a circuit diagram.

FIG. 4 diagrammatically shows essential elements of the regulating device 20 and the computing unit 21. A contact roller sensor 24 serves to detect the speed of rotation of the contact roller 5. A first spindle sensor 25 serves to detect the speed of rotation of the first winding spindle 9. A second spindle sensor 26 detects the speed of rotation of the second winding spindle 10. A first frequency converter 27 is associated with the first spindle motor 16. A second frequency converter 28 is correspondingly associated with the second spindle motor 17. An OR-member 29 serves to change the position of the winding spindles 9 and 10 from the operative position to the reserve position and vice versa.

The computing unit 21 has a PID-regulator 30, a computing member 31, a storage means 32 into which a value table 33 can be inputted, an I-regulator 34 and a further PID-regulator 35. Also associated with the computing unit is a timer 36 which serves to measure time. A servoregulator 37 is connected upstream of the drum motor 18. A resolver 38 is arranged in the motor 18. The individual elements of the regulating device 20 are connected together in the manner indicated by the respective lines. In that connection, the following references are used:

D=diameter 23 of the bobbin 15 (variable)

$n_s$=speed of rotation of the winding spindle 9 or 10 (variable)

$n_k$=speed of rotation of the contact roller 5 (constant)

phi=rotary angle 22 of the drum 6 (variable)

f=frequency

T=time omega=angular speed of the rotary movement of the drum 6 (variable).

An index 'ist' identifies a variable parameter in terms of its respectively current value. An index 'soll' identifies a calculated reference or target value. The term DELTA denotes a difference value.

Figure 5:
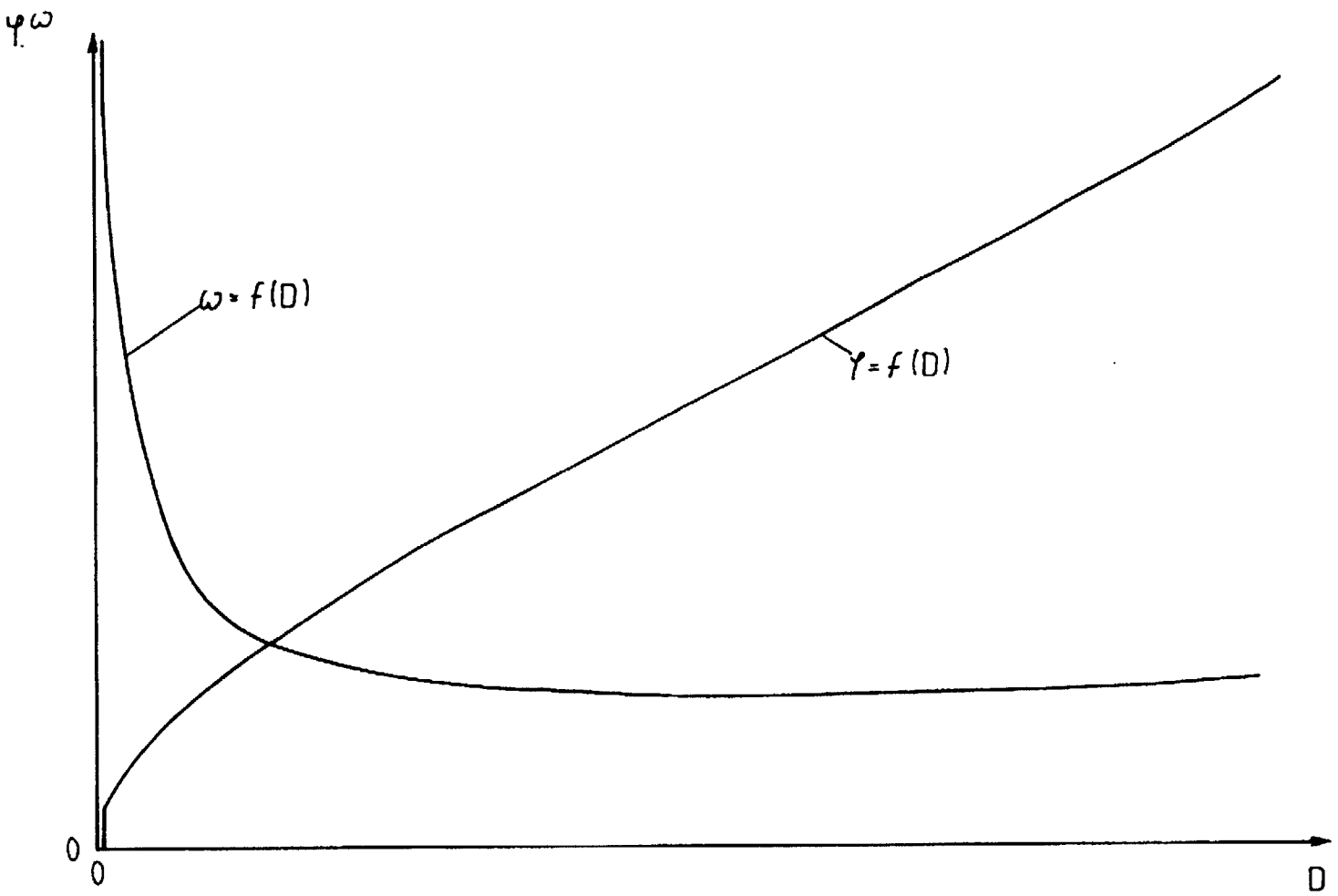
FIG. 5 is a graph showing the reference value of the rotary angle and the variation in the angular speed in relation to the increasing diameter of the bobbin or time.

FIG. 5 shows the variation in the rotary angle phi of the drum 6 as a function of the increase in diameter of the bobbin 15 in relation to the diameter D or time. The variation in angular speed in relation to time is also illustrated. That curve is of a hyperbolic character.

Two possible modes of operation of the regulating device 20 of the winding machine 3 are described hereinafter:

In a first mode of operation, a value table 33 is stored in the storage means 32 of the computing unit 21. In that value table 33, certain rotary angles 22 ($phi_{soll}$) are associated with the increasing diameters 23 of the bobbin 15 (for example in bobbin increase steps of each 2 mm). At the beginning of the winding phase the timer 36 is used to measure the time which results in an increase in bobbin diameter of for example 2 mm. The current diameter 23 (D) of the bobbin is computed from the speed of rotation $n_k$ of the contact roller and the speed of rotation $n_s$ of the bobbin 15 or the winding spindle 9 which is at that time in the operative position. The peripheral speed of the contact roller 5 is a function of the speed of the yarn 1 which is assumed to be constant. That means that the increase in the current diameter D of the bobbin 15 is as follows:

$$D=f(n_s, n_k)$$

When an established increase in bobbin size DELTA D (for example 2 mm) is reached, the associated reference or target value of the rotary angle 22 ($phi_{soll}$) is taken from the value table 33. The angular speed omega is calculated from the measured time T and the reference or target value of the rotary angle:

$$omega=f(phi_{soll}, T).$$

The drum 6 is further rotated at that angular speed until the next bobbin increase DELTA D is reached. The rotary angle $phi_{ist}$ attained in that case, supplied by the resolver 38 of the motor 18 of the drum, is fed back as an actual value to the I-regulator 34 of the computing unit 21 and compared to the reference or target value $phi_{soll}$ from the stored value table 33. In the event of a difference, the angular speed omega is corrected by the I-regulator 34 of the regulating device 20 by iterative approximation so that the difference between the $phi_{soll}$ and $phi_{ist}$ becomes progressively smaller in the course of the winding phase.

In a second mode of operation, it is however also possible to operate the regulating device 20 without involving the storage of a value table:

The respectively current diameter 23 of the bobbin 15 (D), as above, is in this case also calculated from the speed of rotation $n_k$ of the contact roller 5 and the speed of rotation $n_s$ of the winding spindle 9 or 10 with the bobbin 15. The peripheral speed of the contact roller 5 is a function of the speed of the yarn 1, at which it is fed or wound on:

$$D=f(n_s, n_k).$$

From this D value that and from a constant, formed from the geometrical data of the winding machine 3, the associated reference or target value of the rotary angle $phi_{soll}$ is calculated:

$$phi_{soll}=f(D, \text{constant}).$$

The angular speed omega is calculated by referring to the measured time T between the start of two computing cycles and the calculated value of the rotary angle $phi_{soll}$:

$$omega=f(phi_{soll}, T).$$

At the start of the winding phase (in the first computing cycle) the time T=0, the angular speed omega is also equal to zero. The drum 6 is stationary until the second computing cycle begins. The drum 6 is further rotated at the calculated angular speed omega (>0) until the next computing cycle gives a new value for the angular speed omega.

The reference or target value of the rotary angle $phi_{soll}$ is compared to the actual value of the rotary angle $phi_{ist}$, supplied by the resolver 38 of the drum motor 18. In the event of differences between these values, the angular speed omega is corrected by the I-regulator 34 of the regulating device 20 by iterative approximation so that the difference of $phi_{soll}$ and $phi_{ist}$ becomes progressively smaller in the course of the winding phase.

It will be appreciated from the above disclosure that the drum 6 is driven continuously during the winding operation. There are no stoppage times. It is only the angular speed omega that is adapted and changed in steps.

While the specification and drawings describe and illustrate a preferred embodiment of the invention, it will be understood by those skilled in the art that variations and modifications thereof can be made without departing from the spirit and scope of the invention, as defined in the accompanying claims.

We claim:

1. A winding apparatus for continuously winding yarn received from a yarn receiving path on a bobbin, said apparatus comprising:

a winding drum having a drum face and being rotatable about a central rotation axis that passes through said drum face;

a winding spindle rotatably mounted to said drum face in a position radially displaced from the central rotation axis of said drum, said winding spindle being alternately positionable in a winding position and a bobbin change position through rotation of said winding drum, wherein said winding spindle is initially positioned in the winding position for receiving the bobbin disposed about said winding spindle;

a contact roller positioned along the receiving path of the yarn upstream of said winding drum and being in peripheral contact with the bobbin;

drive means for independently rotating said winding drum and said winding spindle;

sensing means for sensing the respective rotational speeds of said contact roller and said winding spindle; and a regulating device electronically connected to said drive means and said sensing means adapted to continually regulate the rotational speed of said winding drum in response to the sensed rotational speeds of said contact roller and said winding spindle such that said winding drum is continuously rotated about its central rotation axis during the winding process and said winding spindle is continuously moved away from said contact roller as the amount of yarn wound on the bobbin increases so that said contract roller remains in peripheral contact with the bobbin throughout the winding process.

2. The winding apparatus of claim, 1 further including a laying device that is connected to said winding apparatus in a position upstream of said winding drum along the receivings path of the yarn, wherein said laying device guides the yarn to said contact roller before it is wound about the bobbin.

3. The winding apparatus of claim 1, wherein said regulating device includes a computer.

4. The winding apparatus of claim 3, wherein said computer includes a microprocessor and storage means for storing information that correlates bobbin diameters with target angular position values, wherein said microprocessor continually calculates a bobbin diameter from the sensed rotational speeds, continually determines a target angular position value from the stored information by correlating the calculated bobbin diameter with this position value, and continually adjusts the rotational speed of said winding drum such that the actual angular position of said winding spindle will approximate the determined target angular position value.

5. The winding apparatus of claim 3, wherein said computer includes a microprocessor that continually calculates a bobbin diameter from the sensed rotational speeds, continually calculates a target angular position for said spindle from the calculated bobbin diameter, and continually adjusts the rotational speed of said winding drum such that the actual angular position of said winding spindle will approximate the target angular position.

6. The winding apparatus of claim 1, wherein said contact roller is deflectably mounted to said winding apparatus such that said contact roller is displaced radially away from said winding spindle by the yarn that has been wound around the bobbin.

7. The winding apparatus of claim 6, wherein said contact roller is mounted such that it is urged against said winding spindle with a predetermined amount of contact pressure throughout the winding process.

8. A winding apparatus for continuously winding yarn received from a feeding path on a bobbin, said apparatus comprising:

a winding drum having a drum face and being rotatable about a central rotation axis that passes through said drum face;

a pair of winding spindles each for receiving the bobbin and each rotatably mounted to said drum face in positions radially displaced from the central rotation axis of said drum, said winding spindles each being alternately positionable in a winding position and in a bobbin change position respectively in response to rotation of said winding drum about the central rotation axis, wherein one winding spindle is initially positioned in the winding position and the other winding spindle is initially positioned in the bobbin change position and wherein the bobbin is mounted about said winding spindle initially positioned in the winding position;

a contact roller positioned along the feeding path of the yarn upstream of said winding drum and being in peripheral contact with the bobbin;

drive means for independently rotating said winding drum and both of said winding spindles;

sensing means for sensing the respective rotational speeds of said contact roller and said winding spindle initially positioned in the winding position; and a regulating device electronically connected to said drive means and said sensing means, said regulating device adapted to continually regulate the rotational speed of said winding drum in response to the sensed rotational speeds of said contact roller and said winding spindle initially positioned in the winding position such that said winding drum is continuously rotated about its central rotation axis during the winding process and said winding spindle initially positioned in the winding position is continuously moved away from said contact roller as the amount of yarn wound on the bobbin increases so that said contract roller remains in peripheral contact with the bobbin throughout the winding process.

9. The winding apparatus of claim 8, wherein once the bobbin mounted about said winding spindle initially positioned in the winding position is full, the positions of said winding spindles are reversed such that said winding spindle initially positioned in the bobbin change position is repositioned in the winding position, and said winding spindle initially positioned in the winding position is repositioned in the bobbin change position so that the full bobbin is removed and replaced with an empty bobbin.

10. A method for continuously winding yarn on a bobbin with a winding apparatus, the winding apparatus including a winding drum that is rotatable about a central rotation axis, a winding spindle rotatably mounted to the drum in a position radially displaced from the central rotation axis and having the bobbin disposed thereon, and a contact roller in peripheral contact with the bobbin, the method comprising the steps of:

continuously, independently rotating the winding spindle and winding drum at predetermined speeds;

winding the yarn around the bobbin disposed on the spindle;

continually sensing the rotational speeds of the winding spindle and the contact roller;

continually determining target angular positions for the winding spindle from the sensed rotational speeds of the winding spindle and the contact roller; and continually adjusting the rotational speed of the winding drum such that the actual angular position of the winding spindle will approximate the target angular position for the winding spindle so the contact roller remains in peripheral contact with the yarn being wound on the bobbin as the winding spindle is continuously moved away from the contact roller.

11. The method of claim 10, wherein the step of continually determining target angular positions for the winding spindle comprises continually calculating a current diameter of the bobbin from the sensed rotational speeds of the winding spindle and the contact roller, continually correlating the calculated current diameter with the target angular position for the spindle from through correlation with the calculated current bobbin diameter.

12. The method of claim 11, wherein the adjusted rotational speed of the winding drum is at least partially derived from a preceding rotational speed of the winding drum.

13. The method of claim 11, wherein the steps of calculating the current diameter of the bobbin, determining the target angular position, and adjusting the rotational speed of the winding drum, are repeatedly executed at intervals of 10 msec.

14. The method of claim 13, wherein the steps of calculating the current diameter of the bobbin, determining the target angular position, and adjusting the rotational speed of the winding drum, are conducted by a microprocessor.

15. The method of claim 10, wherein the step of continually determining target angular positions for the winding spindle comprises continually calculating a current diameter of the bobbin from the sensed rotational speeds of the winding spindle and the contact roller, continually calculating the target angular position for the spindle from the calculated current bobbin diameter.

16. The method of claim 15, wherein the adjusted rotational speed of the winding drum is at least partially derived from a preceding rotational speed of the winding drum.

17. The method of claim 15, wherein the steps of calculating the current diameter of the bobbin, calculating the target angular position, and adjusting the rotational speed of the winding drum, are repeatedly executed at intervals of 10 msec.

18. The method of claim 17, wherein the steps of calculating the current diameter of the bobbin, calculating the target angular position, and adjusting the rotational speed of the winding drum, are conducted by a microprocessor.

* * * * *